US006935906B2

(12) United States Patent
Orihara

(10) Patent No.: US 6,935,906 B2
(45) Date of Patent: Aug. 30, 2005

(54) ELECTRIC CONNECTOR

(75) Inventor: Masayuki Orihara, Yokohama (JP)

(73) Assignee: J.S.T.Mfg.Co., Ltd., Osaka (JP)

( * ) Notice: Subject to any disclaimer, the term of this patent is extended or adjusted under 35 U.S.C. 154(b) by 0 days.

(21) Appl. No.: 10/900,379

(22) Filed: Jul. 28, 2004

(65) Prior Publication Data

US 2005/0026510 A1 Feb. 3, 2005

(30) Foreign Application Priority Data

Jul. 31, 2003 (JP) ..... 2003-283260

(51) Int. Cl.[7] ..... H01R 13/24
(52) U.S. Cl. ..... 439/824; 439/289
(58) Field of Search ..... 439/700, 824, 439/500, 504, 289

(56) References Cited

U.S. PATENT DOCUMENTS

| | | | | | |
|---|---|---|---|---|---|
| 2,724,096 | A | * | 11/1955 | Klostermann | 439/824 |
| 3,771,110 | A | * | 11/1973 | Reed | 439/737 |
| 4,281,888 | A | * | 8/1981 | Seaman | 439/692 |
| 4,342,497 | A | * | 8/1982 | Morrison | 439/522 |
| 4,508,405 | A | * | 4/1985 | Damon et al. | 439/260 |
| 4,778,408 | A | * | 10/1988 | Morrison | 439/522 |
| 4,904,213 | A | * | 2/1990 | Hock et al. | 439/824 |
| 5,151,040 | A | * | 9/1992 | Tanaka | 439/73 |
| 5,362,241 | A | * | 11/1994 | Matsuoka et al. | 439/66 |
| 5,393,246 | A | * | 2/1995 | Du | 439/482 |
| 5,641,315 | A | * | 6/1997 | Swart et al. | 439/824 |
| 5,643,016 | A | * | 7/1997 | Huss, Jr. | 439/744 |
| 5,667,410 | A | * | 9/1997 | Johnston | 439/700 |
| 5,980,335 | A | * | 11/1999 | Barbieri et al. | 439/824 |
| 6,083,059 | A | * | 7/2000 | Kuan | 439/862 |
| 6,162,103 | A | * | 12/2000 | Ono | 439/824 |
| 6,340,320 | B1 | * | 1/2002 | Ogawa | 439/824 |
| 6,447,343 | B1 | * | 9/2002 | Zhang et al. | 439/700 |
| 6,464,511 | B1 | * | 10/2002 | Watanabe et al. | 439/66 |
| 6,515,496 | B2 | * | 2/2003 | Felici et al. | 324/754 |
| 6,604,864 | B2 | * | 8/2003 | Nguyen | 385/59 |
| 6,663,439 | B2 | * | 12/2003 | Henry et al. | 439/700 |
| 6,716,043 | B2 | * | 4/2004 | Ishizuka | 439/131 |
| 6,758,682 | B1 | * | 7/2004 | Kosmala | 439/66 |
| 6,776,668 | B1 | * | 8/2004 | Scyoc et al. | 439/700 |
| 2004/0077225 | A1 | * | 4/2004 | Chun-Fu | 439/700 |

FOREIGN PATENT DOCUMENTS

EP 1 253 674 A 10/2002

OTHER PUBLICATIONS

European Search Report dated Aug. 30, 2004.

* cited by examiner

*Primary Examiner*—Tho D. Ta
*Assistant Examiner*—Larisa Tsukerman
(74) *Attorney, Agent, or Firm*—Armstrong, Kratz, Quintos, Hanson & Brooks, LLP.

(57) ABSTRACT

An electric connector using a probe-type contact(s) is provided to prevent it from having contact failure and is characterized in that it comprises a housing having at least one through hole, a probe-type contact(s) inserted into the through hole(s), and a terminal portion(s) connected to the probe-type contact(s). In the probe-type contact, a pin-shaped contact(s) is housed in a conductive tubular body in such manner that the contact is energized to move freely by a spring. The tip of the pin-shaped contact is tilted upward at a predetermined angle in a horizontal direction, and is installed into the through hole so as to protrude from the front wall surface of the housing.

10 Claims, 8 Drawing Sheets

ELECTRIC CONNECTOR

BACKGROUND OF THE INVENTION

1. Field of the Invention

The present invention relates to an electric connector, more particularly to the modification of an electric connector using a contact(s) where a pin-shaped contact(s) is housed in a conductive tubular body (bodies) in such manner that the contact(s) is energized to move freely back and forth by a spring(s), which is a so-called probe-type contact.

2. Prior Art

First, an electric connector using a conventional probe-type joint will be described using a drawing. FIG. 8A and FIG. 8B shows the electric connector using the probe-type contact described in Japanese Patent Laid-Open Publication No. 11-149954 publication (Refer to FIG. 6, right column on page 3.), in which FIG. 8A and FIG. 8B respectively show the sectional view of the contact and the side view showing the state of connection of the electric connector with particular equipment.

In the probe-type contact 2, as shown in FIG. 8A and FIG. 8B, a conductive pin 3 is arranged in such manner as to move freely in protruding and withdrawing directions in a conductive tube 4, and a narrow portion is provided at the tip of the conductive tube 4 to prevent the conductive pin 3 from coming out in the protruding direction. Further, a coil spring 5 is provided in a retracted state in the conductive tube 4 so as to elastically energize the conductive pin 3 in the protruding direction.

The probe-type contact 2 constituted in this manner is electrically connected to a circuit board 6 in an electric connector main body 1 of a cell phone and the like as shown in FIG. 8. On the other hand, a battery 7 is installed to the electric connector main body 1 in such manner as to be freely detachable. Then, the conductive pin 3 elastically contacts the terminal 7*a* of the battery 7 in an attached state and thus the electric connector main body 1 and the battery 7 are electrically connected via the terminal 7*a* and the probe-type contact 2.

The battery 7 is attached to the electric connector main body 1 when the terminal 7*a* of the battery 7 contacts the contact of the conductive pin 3 of the probe-type contact 2 in a horizontal direction marked by the arrow X. At this point, the contact position of the terminal 7*a* and the conductive pin 3 is a contact point $x_0$ on the surface of the terminal 7*a*, and when the battery is moved further in the direction of X, the conductive pin 3 withdraws and recedes into the conductive tube 4 resisting the energizing force of the spring 5. Such movement of the conductive pin 3 causes its tip portion to elastically contact the battery terminal 7*a*, and its contact point $x'_0$ is at the same position as the point before the move.

However, there are cases where dust and the like adheres to or an oxide film is formed on the terminal surface of the battery, causing contact failure, thereby preventing good electrical connection.

SUMMARY OF THE INVENTION

The present invention aims to solve the abovementioned problem of the prior art, and the first object of the present invention is to provide an electric connector in which contact failure does not occur in a connector using a probe-type contact.

Further, the second object of the present invention is to provide an electric connector that can be firmly affixed onto a circuit board.

The aforestated objects of the present invention can be achieved by the following constitutions. Specifically, the invention of the electric connector according to Claim 1 of the present invention is characterized in that it is provided with a housing having at least one through hole, a probe-type contact(s) inserted into the through hole(s); and a terminal portion(s) connected to the probe-type contact(s), in which the probe-type contact is such that a pin-shaped contact is housed in a conductive tubular body in such manner as to move freely while being energized by a spring, and the pin-shaped contact at the tip of the contact is tilted upward at a predetermined angle in a horizontal direction and installed into the through hole so as to protrude from the front wall surface of the housing.

Further, the invention according to Claim 2 of the present invention is the electric connector according to Claim 1, in which the predetermined angle is in the range of 6° to 15°.

Furthermore, the invention according to Claim 3 of the present invention is the electric connector according to Claim 1, in which the housing has a plurality of supporting protrusions jutting outward at the bottom portion of the rear side in the direction where the pin-shaped contact protrudes.

Further, the invention of the electric connector according to Claim 4 of the present invention is characterized in that it is provided with a housing having at least one through hole, where the probe-type contact(s) is inserted into the through hole(s) and the terminal portion(s) connected to the probe-type contact(s), where the probe-type contact is such that the pin-shaped contact is housed in the conductive tubular body in such manner as to move freely while being energized by the spring, and the pin-shaped contact at the tip of the contact is tilted upward by a predetermined angle in a horizontal direction and is installed into the through hole so as to protrude from the front wall surface of the housing, and the terminal portion(s) having a contact on one end and a terminal on the other end is formed by a conductive metal plate, and the contact is connected to the tubular body of the probe-type contact.

Further, the invention according to Claim 5 of the present invention is the electric connector according to Claim 4, in which the predetermined angle is in the range of 6° to 15°.

Furthermore, the invention according to Claim 6 of the present invention is the electric connector according to Claim 4, in which the housing has a plurality of supporting protrusions jutting outward at the bottom portion of the rear side in the direction where the pin-shaped contact protrudes.

Further, the invention according to Claim 7 of the present invention is the electric connector according to Claim 4, in which the contact of the terminal portion is connected to the tubular body of the probe-type contact in such manner as to be freely detachable.

Further, the invention according to Claim 8 of the present invention is the electric connector according to Claim 7, in which the contact of the terminal portion is made of a circular ring, and the circular ring is connected to fit into the tubular body of the probe-type contact.

Furthermore, the invention according to Claim 9 of the present invention is the electric connector according to Claim 4, in which the terminal of the terminal portion is at an L-shaped base and at least two connecting pieces are alternately disposed at the front and rear sides and to the right and left sides of the base in a staggered state.

Further still, the invention of the electric connector according to Claim 10 of the present invention is characterized in that it is provided with a housing having at least one through hole into which the probe-type contact(s) is inserted, and the terminal portion(s) is connected to the probe-type contact(s), wherein the probe-type contact is such that a pin-shaped contact is housed in the conductive tubular body in such manner as to move freely while being energized by the spring, and the pin-shaped contact at the tip of the contact is tilted upward at a predetermined angle in a horizontal direction and is installed into the through hole so as to protrude from the front wall surface of the housing, with the terminal portion being substantially L-shaped and consisting of a contact residing atop the L-shape part thereof, an interconnecting piece at its vertical part, and a terminal at its bottom part, and formed by a conductive metal plate.

Further, the invention is the electric connector in which the predetermined angle is in the range of 6° to 15°.

Further, the invention is the electric connector in which the housing has a plurality of supporting protrusions jutting outward at the bottom portion of the rear side in the direction where the pin-shaped contact(s) protrudes.

Further, the invention according is the electric connector in which the contact of the terminal portion is connected to the tubular body of the probe-type contact in such manner as to be freely detachable.

Further, the invention is the electric connector in which the contact of the terminal portion is made of a circular ring, which is connected as to fit into the tubular body of the probe-type contact.

Further still, the invention invention is the electric connector in which the terminal of the terminal portion resides at the L-shaped base and at least two connecting pieces are alternately disposed at the front and rear sides and to the right and left sides of the base in a staggered state.

The above-described constitution of the present invention exhibits the following features. Specifically, according to the electric connector of the present invention, when a component such as a battery is attached to the electric connector that is built into electronic equipment such as a cell phone, the pin-shaped contact of the probe-type contact abuts the terminal of the battery and the like, and the pin-shaped contact withdraws into the tubular body resisting the repulsion of the spring. At the point of withdrawal, the contact point of the pin-shaped contact and the terminal of the battery and the like moves, allowing the pin-shaped contact to rub the surface of the terminal over a predetermined range, which is referred to as a "wiping action". Therefore, in the electric connector of the present invention, even if contamination adheres to the surface of the terminal or an oxide film and the like is formed thereon, the wiping action rubs them off and good electrical connection is achieved.

Further, according to the electric connector of another mode of the present invention, good wiping action can be achieved by selecting the predetermined angle from within the range of 6° to 15°. In addition, since a plurality of supporting protrusions are provided on the lower wall portion on the rear side of the housing, the supporting protrusions abut on the circuit board surface even when the terminal of the battery and the like pushes the pin-shaped contact when force is applied, making the housing draw away from the circuit board, thereby preventing the housing from being peeled off from the circuit board.

Furthermore, according to the electric connector of another mode of the present invention, the terminal portion is separated from the probe-type contact, which facilitates the design and manufacturing of both components. Additionally, since various types of separate connecting portions can be formed, it is possible to draw out the terminal from the housing in any direction (whether upward, downward, rightward, leftward or rearward), thereby increasing flexibility in creating the layout design of equipment for mounting the electric connector.

Further still, according to the electric connector of another mode of the present invention, the contact is connected to the tubular body of the probe-type contact in such manner as to be freely detachable, making for easier assembly and allowing replacement of components as well as facilitating repair. Moreover, since the contact is made of a circular ring, attachment or detachment thereof from the probe-type contact becomes effortless.

Further, according to the electric connector of another mode of the present invention, connection with the circuit board can be achieved by a plurality of the connecting pieces provided at the L-shaped base in a staggered state. Therefore, the number of connecting points is increased, and even if connection failure occurs on one connecting piece, the existence of other connecting pieces practically eliminates the occurrence of almost all connection failures. In addition, the connection made by the connecting pieces serves as the mode of attaching of the connector housing to the circuit board, and therefore providing means for affixing the housing is not necessary.

Further, according to the electric connector of another mode of the present invention, since the terminal portion is substantially L-shaped, it is possible to draw out the terminal to the lower wall surface of housing. Additionally, by mounting the lower wall surface of the housing on the circuit board and connecting the terminal to the circuit wiring of circuit board by soldering, the housing can be affixed to the circuit board without providing the means therefor.

BRIEF DESCRIPTION OF THE DRAWINGS

FIG. 8A is the sectional view of the contact, and FIG. 8B is the side view showing the state of connection thereof with particular equipment.

PREFERRED EMBODIMENTS OF THE INVENTION

The preferred embodiments of the present invention will hereafter be described with reference to the drawings. Note that while the embodiments described below exemplify the technical essence of the present invention, the same embodiments are not confined to the present invention as the other embodiments included in the claims equally apply to the present invention.

EXAMPLE 1

Figure 1:
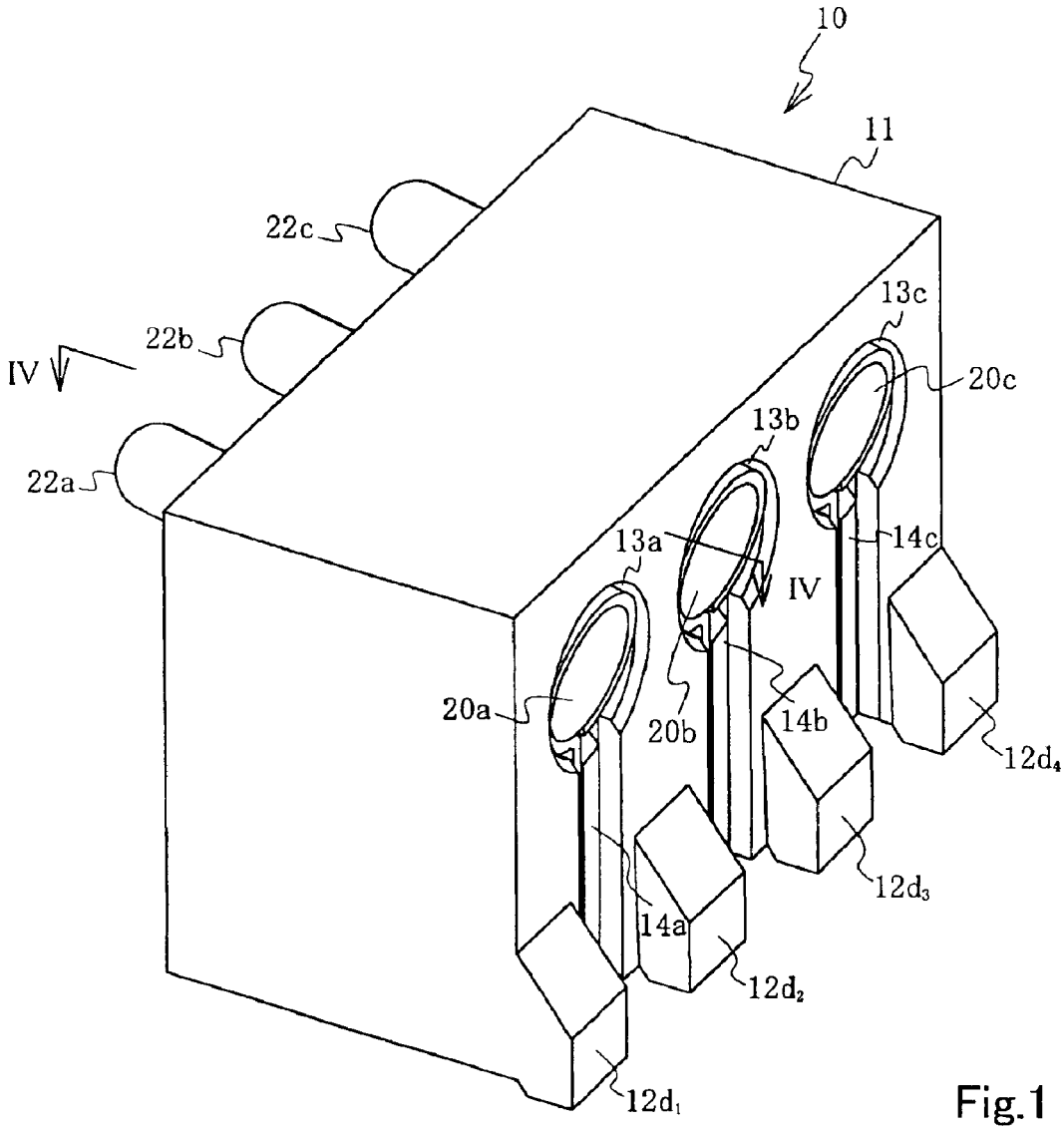
FIG. 1 is a perspective of the external view of the electric connector of the present invention.
Figure 2:
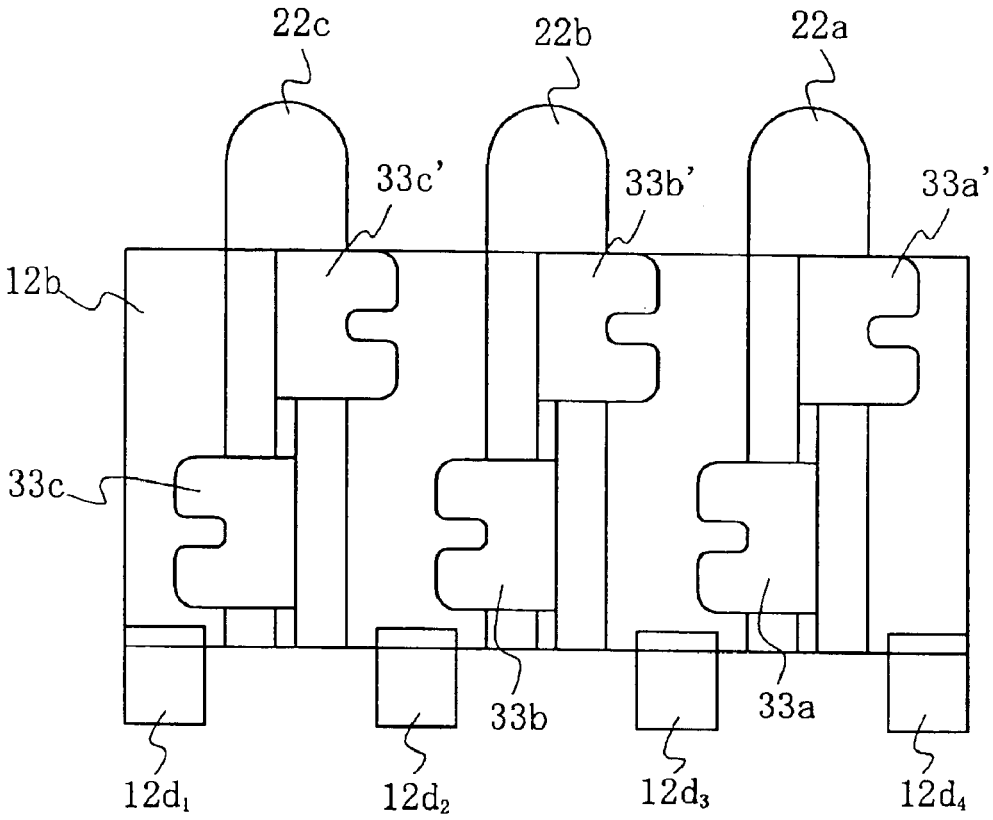
FIG. 2 is a bottom surface view of the electric connector.
Figure 3:
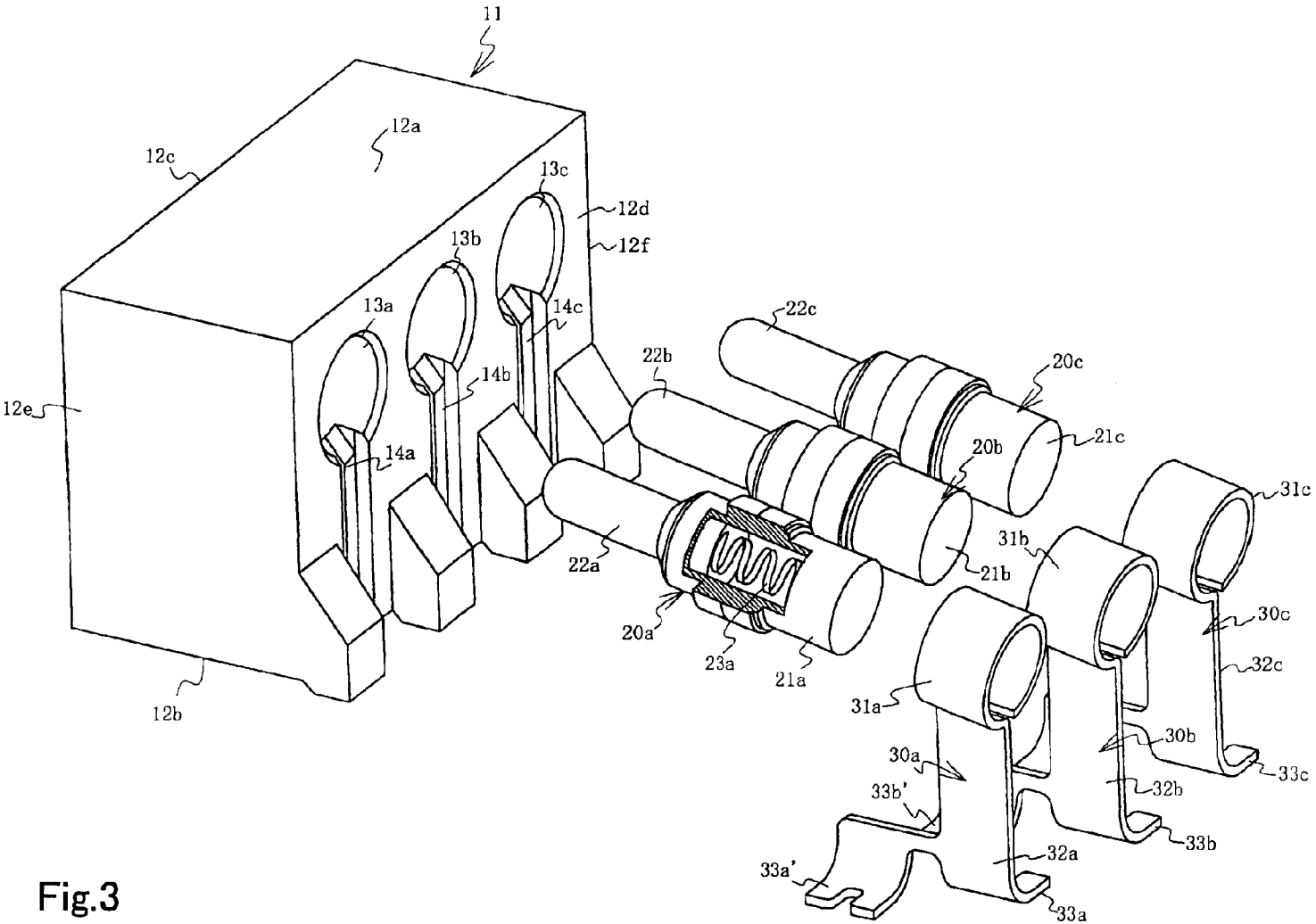
FIG. 3 is an exploded view of the electric connector of FIG. 1.
Figure 4:
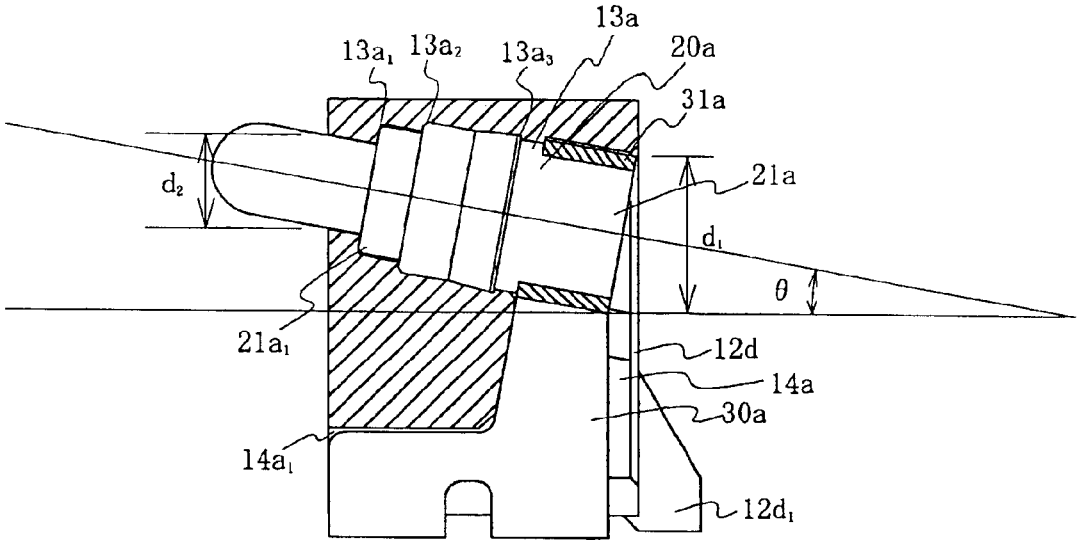
FIG. 4 is a sectional view at IV—IV of FIG. 1.
Figure 6:
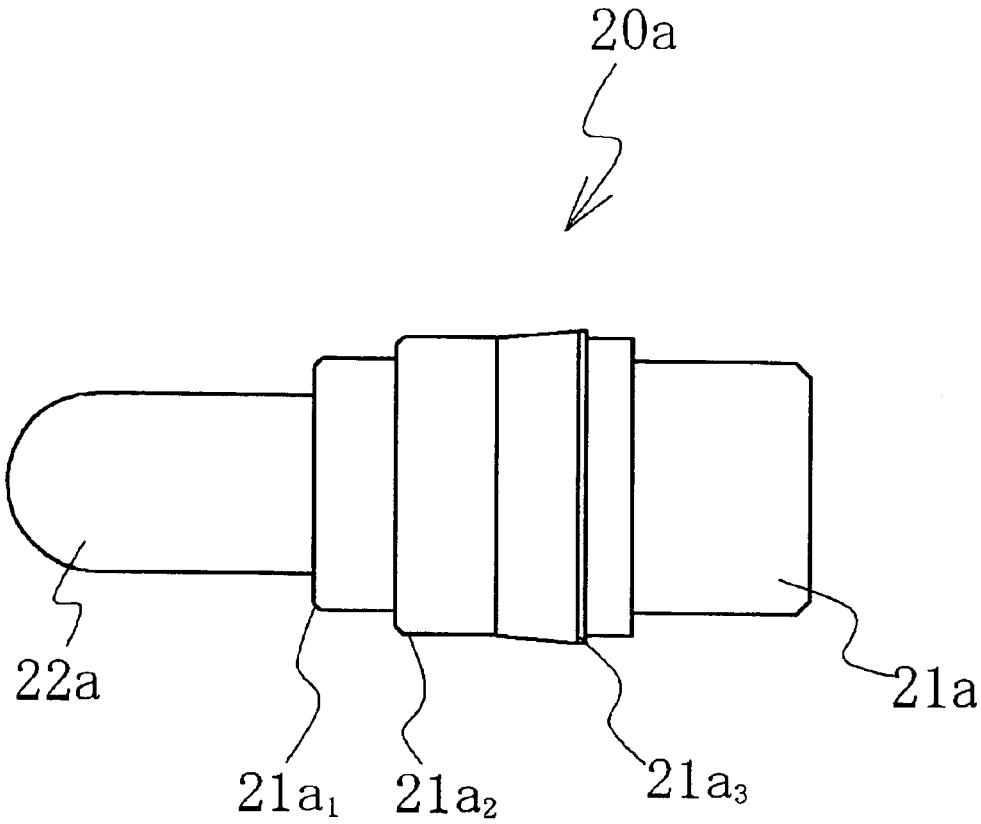
FIG. 6 is a side view of the probe-type contact.
Figure 7:
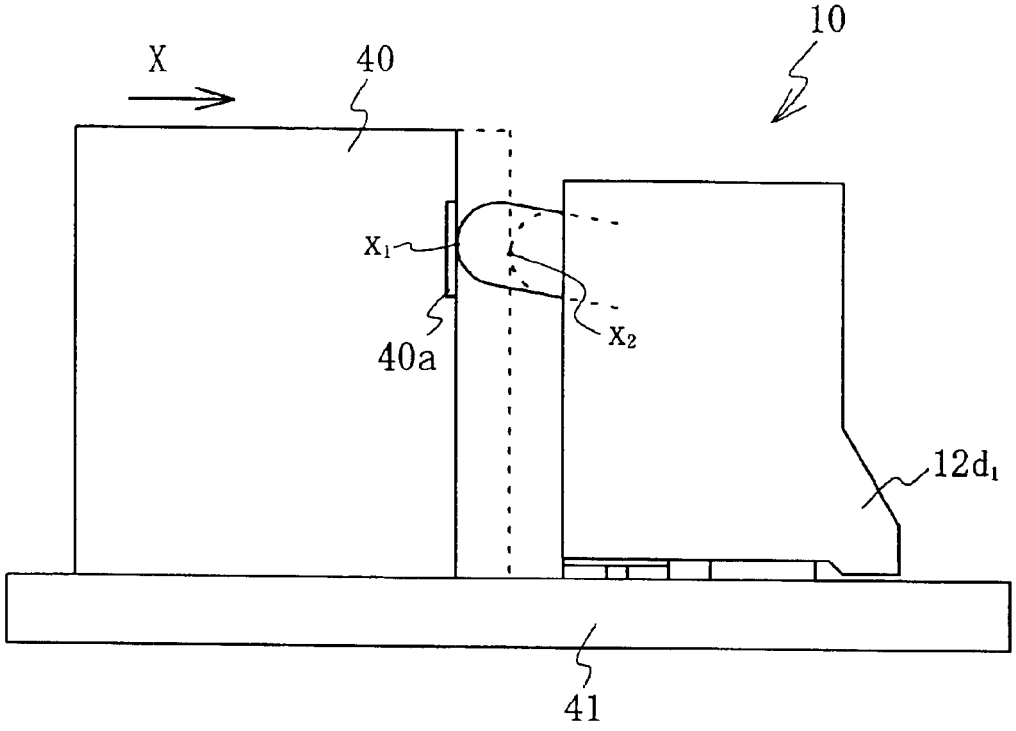
FIG. 7 is a side view showing the state of connection between the electric connector and equipment.
Figure 8A:
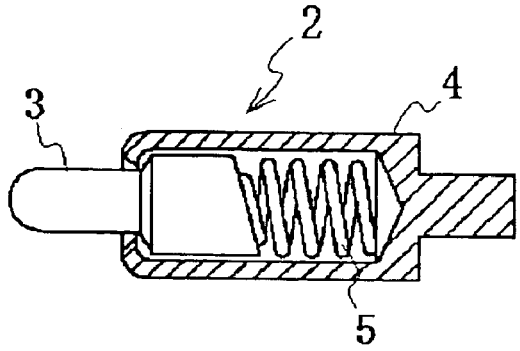
Fig.8A (prior art)
FIG. 8A and FIG. 8B show an electric connector using a probe-type contact of the prior art, where
Figure 8B:
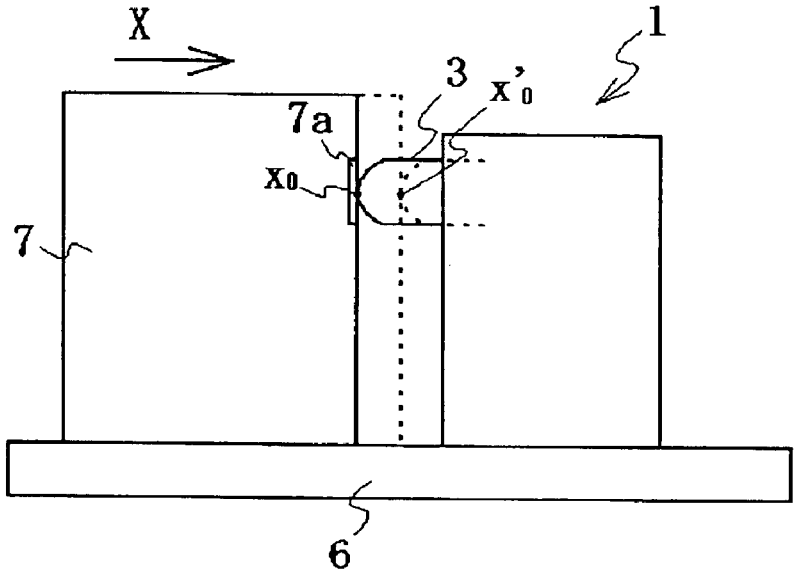
Fig.8B (prior art)

FIG. 1 is a perspective of the external view of the electric connector of the present invention, while FIG. 2 is the bottom surface view of the electric connector and FIG. 3 is an exploded view of the electric connector shown in FIG. 1. FIG. 4 is the sectional view at IV—IV of FIG. 1, while FIG. 5A, FIG. 5B and FIG. 5C respectively show the front, right side and bottom surface views of the terminal portion of FIG. 3. FIG. 6 is a side view of the probe-type contact, and FIG. 7 is a side view showing the state of connection between the electric connector and equipment.

An electric connector 10 is provided with a housing 11 having three through holes 13*a* to 13*c*, probe-type contacts 20*a* to 20*c* inserted into each through hole, and terminal portions 30*a* to 30*c* connected to each probe-type contact. The probe-type contacts 20*a* to 20*c* are constituted as follows. Pin-shaped contacts 22*a* to 22*c* are housed in conductive tubular bodies 21*a* to 21*c* in such manner as to move freely back and forth while being energized by springs (FIG. 3 shows only the spring 23*a*). The contacts are installed into the through holes 13*a* to 13*c* such that the tip portions of the probe-type contacts 20*a* to 20*c* are tilted upward at a predetermined angle in a horizontal direction, and the pin-shaped contacts 22*a* to 22*c* protrude from the surface of a front wall 12*c* of the housing 11.

Each member that constitutes the electric connector 10 will be described next.

As shown in FIG. 3, the housing 11 which is made of synthetic resin material consists of a cube having an upper wall 12*a*, a bottom wall 12*b*, a front wall 12*c*, a rear wall 12*d*, and right and left sidewalls 12*e*, 12*f*.

A part of the bottom wall 12*b* surface extends backward on the rear wall 12*d* side. As shown in FIG. 2, the surface of the extended bottom wall 12*b* is made up of a plurality of supporting protrusions $\mathbf{12}d_1$ to $\mathbf{12}d_4$ that are integrally formed with the rear wall, and are provided on the rear wall surface at substantially equal gaps.

Further, in the housing 11, the three through holes 13*a* to 13*c* penetrating from the rear wall 12*d* toward the front wall 12*c* surface are provided so as to be tilted upward from the rear wall 12*d* toward the front wall 12*c* surface at a predetermined angle in a horizontal direction. The tilt angle will be described in detail later.

The through holes 13*a* to 13*c* are substantially circular in shape, and slits 14*a* to 14*c* of a narrow groove state are formed so as to communicate with the said through holes, extending to the bottom wall 12*b*.

The through holes 13*a* to 13*c* (FIG. 4 illustrates only the through hole 13*a*) are tilted at a predetermined angle in the horizontal direction so as to rise upward to the left from the rear wall 12*d* toward the front wall 12*c*. It is preferable that the tilt angle θ be within the range of 6° to 15°. When the tilt angle is selected from the aforeprescribed range and the probe-type contact is installed to each through hole, the pin-shaped contact (hereinafter, referred to as a "pin contact") effectively wipes the surface of another terminal (the battery terminal, for example) when it contacts the surface of such other terminal.

Furthermore, the diameter of the inner wall of the through holes 13*a* to 13*c* gradually becomes smaller from the rear wall 12*d* toward the front wall 12*c*. The diameter $d_2$ of the openings on the front wall 12*c* is smaller than the diameter $d_1$ of the openings on the rear wall 12*d*, but slightly larger than the diameter of the pin contact 22*a*, thereby not causing a problem in moving the pin contact 22*a* even if it contacts the inner wall of the through hole.

Further, as shown in FIGS. 4 and 6, the first, second and third steps $\mathbf{13}a_1$, $\mathbf{13}a_2$, $\mathbf{13}a_3$ are formed on the inner wall surface of the through hole 13*a*, and a tip step $\mathbf{21}a_1$, a central step $\mathbf{21}a_2$, and a rear step $\mathbf{21}a_3$ of the tubular body of the probe-type contact 20*a* are hooked, positioned and affixed to the steps $\mathbf{13}a_1$, $\mathbf{13}a_2$, $\mathbf{13}a_3$ respectively, thereby preventing the probe-type contact 20*a* from coming off from the through hole 13*a*. The other through holes 13*b*, 13*c* also have the same structure as the through hole 13*a* shown in the drawing, and each of the probe-type contacts 20*b*, 20*c* are likewise positioned and arranged in the same manner.

The slits 14*a* to 14*c* communicating with the openings on the rear wall 12*d* (FIG. 4 shows only the slit 14*a*) are L-shaped and whose right and left sides are reversed, with a slit width formed slightly wider than the thickness of an interconnecting piece 32*a* that constitutes a portion of the terminal portion 30*a*. Then, the groove of the vertical portion of the L-shaped slit almost reaches the central area of the housing 11 from the rear wall 12*d* toward the front wall 12*c*, and a groove $\mathbf{14}a_1$ in the area close to the bottom wall 12*b* surface communicates from the rear wall 12*d* to the front wall 12*c*. The other slits 14*b*, 14*c* are similarly shaped. Note that the housing 11 need not be in cubic form, as it may be of any shape. For example, it may be a plate-shaped body.

The probe-type contacts 20*a* to 20*c* which are formed by metal of good conductivity, consist of the tubular bodies 21*a* to 21*c* having a predetermined diameter, the pin contacts 22*a* to 22*c* which are housed in the tubular bodies in such manner as to move freely and whose tips protrude from the front surface of the tubular bodies, and springs 23*a* to 23*c* (FIG. 3 illustrates only the spring 23) which are housed in the tubular bodies and energize the pin contacts so as to cause the contacts to protrude toward the front surface of the tubular bodies.

Of varying diameters, the tip step $\mathbf{21}a_1$, the central step $\mathbf{21}a_2$, and the rear step $\mathbf{21}a_3$ are formed from the tip to the rear end of the tubular bodies 21*a* to 21*c* (FIG. 6 illustrates only the probe-type contact 20*a*), and the diameter of the central step $\mathbf{21}a_2$ is smaller than the diameter of the rear step $\mathbf{21}a_3$. The other probe-type contacts 20*b*, 20*c* are similarly formed.

When the pin contact 22*a* of the probe-type contact is pushed by the terminal of the battery and the like, the pin contact withdraws, resisting the energizing force of the spring, thereby elastically contacting the terminal by virtue of the spring, and a state of good electrical connection is maintained.

Figure 5A:
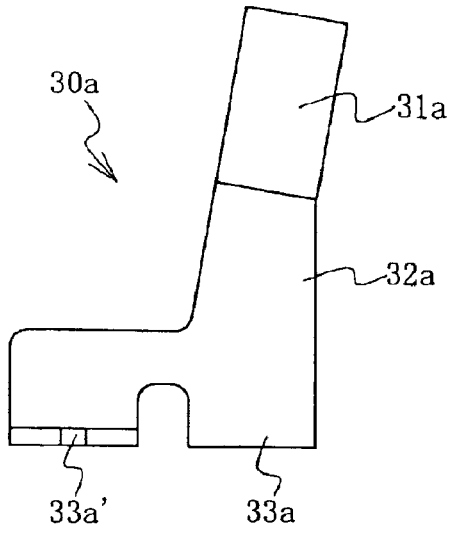
FIG. 5A, FIG. 5B and FIG. 5C respectively show the front, right side and bottom surface views of the terminal portion of FIG. 3.
Figure 5B:
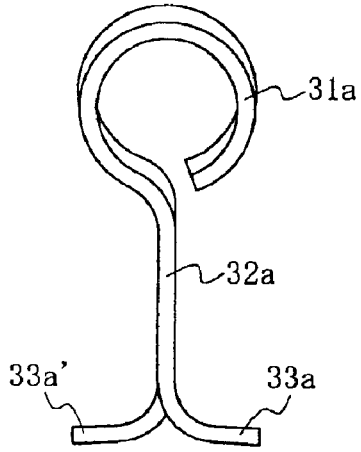
Figure 5C:
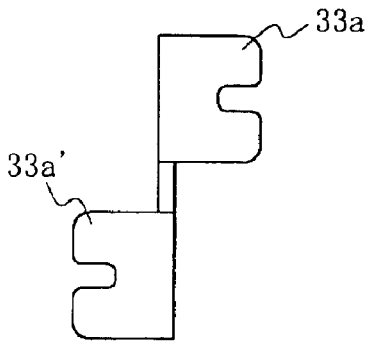

The terminal portions 30*a* to 30*c*, in the form of a plate-shaped body having good conductivity by bending process (FIG. 5A illustrates only the terminal portion 30*a*), are L-shaped whose right and left portions are substantially reversed.

The terminal portion 30*a* consists of a circular contact 31*a* made up of the circular ring provided atop the L-shaped portion thereof, the interconnecting piece 32*a* that vertically comes down from the circular contact to a vertical portion, and terminal pieces 33*a*, 33*a*' at the bottom. The diameter of the ring of the circular contact 31*a* is substantially the same or slightly bigger than the diameter of the tubular body 21*a* of the probe-type contact 20*a*, which is designed in such manner that the circular contact 31*a* is pressed into the tubular body 21*a* and good electrical connection is thereby obtained by elastic force.

Further, the bottom end of each of the interconnecting pieces 32*a*, 32*b* and 32*c* extends in one direction at the bottom of the L-shaped part of the terminal portion, and a plurality of the connecting pieces 33*a*, 33*a*' are formed in a staggered manner to the right and left sides of the bottom of the extended area.

A flat surface of a predetermined size is formed at the bottom surface of each of the connecting pieces 33*a*, 33*a*', designed to tightly contact the surface of the circuit board when it is mounted on the board.

Since a plurality of the connecting pieces 33*a*, 33*a*' which have a flat bottom surface have staggered positions on the right, left, front and rear portions of the interconnecting piece, the connecting area with the wiring becomes wider when the connecting pieces are connected by soldering to the wiring on the circuit board, and therefore, good electrical connection is achieved. In addition, firm connection is attained which is useful for affixing the housing as well, eliminating the need to provide means for affixing the housing 11 onto the board.

Meanwhile, although the terminal portions 30*a* to 30*c* are L-shaped, the shape may be changed provided that the terminal pieces lead out to any direction from the top portion, right and left portions, and the rear portion. Further, the shape of the contact need not be circular and may be of any shape. Because the terminal portions can take any form, flexibility in creating their design is secured for purposes of installing them onto the circuit board or in the body of particular equipment.

The assembly method of fitting the contact to the housing will be described hereafter.

The three probe-type contacts 20*a* to 20*c* are inserted into the through holes 13*a* to 13*c* from the rear wall 12*d* of the housing 11 with the pins 22*a* to 22*c* facing forward. In this manner, the tip step 21$a_1$, the central step 21$a_2$, and the rear step 21$a_3$ of the tubular bodies of the probe-type contacts 20*a* are hooked, positioned and affixed on the steps 13$a_1$, 13$a_2$, 13$a_3$ respectively, as shown in FIG. 4. The other probe-type contacts 20*b*, 20*c* are also inserted and affixed to the corresponding through holes 13*b* and 13*c* in the afore-described manner.

Subsequently, the circular rings 31*a* to 31*c* of the corresponding terminal portions 30*a* to 30*c* are pushed into the through holes 13*a* to 13*c* and thereafter made to fit into the rear ends of the tubular bodies 21*a* to 21*c* of the probe-type contacts, and are thereby electrically connected to the tubular bodies. At the same time, the interconnecting pieces 32*a* to 32*c* of the terminal portions 30*a* to 30*c* are pressed into the slits 14*a* to 14*c* and affixed thereto. In this manner, the connecting pieces 33*a*, 33*a*', 33*b*, 33*b*', 33*c*, 33*c*' are arranged at the front, rear, right and left positions on the bottom wall surface 12*b* of the housing 11.

Thereafter, the connecting pieces 33*a*, 33*a*', 33*b*, 33*b*', 33*c*, 33*c*' are connected by soldering to the circuit wiring (not shown) of a circuit board 41 and thereby electrically connected thereto while the housing 11 is also affixed to the circuit board 41 at the same time.

FIG. 7 shows the state in which the electric connector 10 is attached to the circuit board 41, and a battery component 40 is installed to the circuit board 41 via the electric connector 10. When the battery component 40 is connected to the electric connector 10, a battery terminal 40*a* contacts the pin contact 22*a* of the probe-type contact 20 in a horizontal direction marked by the arrow X. At this point, the contact position of the terminal 40*a* and the pin contact 22*a* is a contact point $x_1$ on the surface of the terminal. When the battery is moved further in the direction of X, the pin contact 22*a* withdraws and recedes into the tubular body 21*a* resisting the energizing force of the spring, and the contact point of the pin contact 22*a* and the battery terminal 40*a* moves to $x_2$ due to the movement of the pin contact. Concurrently, the surface of the terminal 40*a* moves from the contact point $x_1$ to $x_2$, and the contact point of the pin contact 22*a* rubs the terminal surface and wiping is performed. Because of the wiping action, oxide film and the like that may form on the surface of the terminal is peeled off, and good electrical connection is thereby achieved. Meanwhile, such wiping action similarly ensues in the other terminals 40*b*, 40*c*, obtaining the same effect.

Furthermore, the electric connector 10 is supported by the supporting protrusion 12$d_1$ provided on the rear surface of the housing thereof even if strong force is applied from the front wall direction of the housing when the component such as a battery is installed, preventing the electric connector from being peeled off from the board 41.

What is claimed is:

1. An electric connector, comprising:

a housing having at least one through hole, a probe-type contact(s) inserted into the through hole(s); and a terminal portion(s) connected to the probe-type contact (s), wherein the probe-type contact consists of a pin-shaped contact housed in a conductive tubular body in such manner as to move freely while being energized by a spring, and the tip of the pin-shaped contact being tilted upward at a predetermined angle in a horizontal direction and installed into the through hole so as to protrude from the front wall surface of the housing, said terminal portion having a contact on one end and a terminal on the other end and is formed by conductive metal plate, and the contact is connected to the tubular body of said probe-type contact, wherein the terminal of said terminal portion is at an L-shaped base and at least two connecting pieces are alternately disposed at the front and rear sides and to the right and left sides of the base in a staggered state.

2. The electric connector according to claim 1, wherein the said predetermined angle is within the range of 6° to 15°.

3. The electric connector according to claim 1, wherein said housing has a plurality of supporting protrusions jutting outward at the bottom portion of the rear side in the direction where the said pin-shaped contact protrudes.

4. The electric connector according to claim 1, wherein the contact of said terminal portion is connected to the tubular body of said probe-type contact in such manner as to be freely detachable.

5. The electric connector according to claim 4, wherein the contact of said terminal portion is made of a circular ring, and the circular ring is connected as to fit into the said tubular body of the probe-type contact.

6. An electric connector, comprising:

a housing having at least one through hole, a probe-type contact(s) inserted into the through hole(s); and a terminal portion(s) connected to the probe-type contact (s), wherein the probe-type contact consists of a pin-shaped contact housed in the conductive tubular body in such manner as to move freely while being energized by the spring, and the tip of the pin-shaped contact being tilted upward at a predetermined angle in a horizontal direction and installed into the through hole so as to protrude from the front wall surface of the housing, and the said terminal portion, which is formed by a conductive metal plate, being substantially L-shaped and consisting of a contact residing atop the L-shape part thereof, an interconnecting piece at its vertical part, and a terminal at its bottom part, wherein the terminal of the said terminal portion is at an L-shaped base and at least two connecting pieces are alternately disposed at the front and rear sides and to the right and left sides of the base in a staggered state.

7. The electric connector according to claim 6, wherein the said predetermined angle is within the range of 6° to 15°.

8. The electric connector according to claim 6, wherein the said housing has a plurality of supporting protrusions jutting outward at the bottom portion of the rear side in the direction where said pin-shaped contact is protruded.

9. The electric connector according to claim 6, wherein the contact of the said terminal portion is connected to the tubular body of the said probe-type contact in such manner as to be freely detachable.

10. The electric connector according to claim 9, wherein the contact of the said terminal portion is made of a circular ring which is connected as to fit into the said tubular body of the probe-type contact.

* * * * *